US008607798B2

(12) United States Patent
Turkbas et al.

(10) Patent No.: US 8,607,798 B2
(45) Date of Patent: Dec. 17, 2013

(54) CUSTOM MOUTHGUARD

(75) Inventors: Jay N. Turkbas, Orono, MN (US); Daniel J. Brett, Kent, OH (US)

(73) Assignee: Shock Doctor, Inc., Plymouth, MN (US)

( * ) Notice: Subject to any disclaimer, the term of this patent is extended or adjusted under 35 U.S.C. 154(b) by 0 days.

(21) Appl. No.: 13/151,814

(22) Filed: Jun. 2, 2011

(65) Prior Publication Data

US 2012/0111343 A1 May 10, 2012

Related U.S. Application Data

(60) Provisional application No. 61/350,555, filed on Jun. 2, 2010.

(51) Int. Cl.
*A61F 5/14* (2006.01)

(52) U.S. Cl.
USPC ..... 128/862; 128/859; 128/861; 264/510; 264/553; 264/554

(58) Field of Classification Search
USPC ..... 128/848, 859, 861–862; 602/902; 264/510, 553, 554
See application file for complete search history.

(56) References Cited

U.S. PATENT DOCUMENTS

| | | | |
|---|---|---|---|
| 257,038 | A | 4/1882 | McMann |
| 1,117,928 | A | 11/1914 | Thurmond |
| 1,146,264 | A | 7/1915 | Kelly |
| 1,323,832 | A | 12/1919 | Chige |
| 1,461,209 | A | 7/1923 | Bridges |
| 1,470,888 | A | 10/1923 | Smedley |
| 1,487,392 | A | 3/1924 | Lee |
| 2,118,980 | A | 5/1938 | Montgomery et al. |
| 2,257,709 | A | 9/1941 | Anderson |
| 2,521,039 | A | 9/1950 | Carpenter |
| 2,659,366 | A | 2/1952 | Savarese |
| 2,630,117 | A | 3/1953 | Coleman |
| 2,643,652 | A | 6/1953 | Cathcart |
| 2,669,988 | A | 2/1954 | Carpenter |
| 2,678,043 | A | 5/1954 | Stark |
| 2,694,397 | A | 11/1954 | Herms |
| 2,702,032 | A | 2/1955 | Freedland |
| 2,708,931 | A | 5/1955 | Freedland |
| 2,750,941 | A | 6/1956 | Cathcart |

(Continued)

FOREIGN PATENT DOCUMENTS

| | | |
|---|---|---|
| AU | 1990/62951 | 4/1991 |
| AU | 1992/29170 | 3/1997 |

(Continued)

OTHER PUBLICATIONS

International Search Report issued in PCT/US94/05305, mailed Oct. 4, 1994, 2 pages.

(Continued)

*Primary Examiner* — Tatyana Zalukaeva
*Assistant Examiner* — Camtu Nguyen
(74) *Attorney, Agent, or Firm* — Faegre Baker Daniels LLP

(57) ABSTRACT

A custom mouthguard may be formed from a multiple layer assembly including an ethylene vinyl acetate/thermoplastic polyurethane layer, an ethylene vinyl acetate layer and an intervening impact shield and elastomeric framework. The elastomeric framework may include one or more posterior occlusal pads. The custom mouthguard may be molded to a positive mold of an individual's upper teeth and gums.

19 Claims, 5 Drawing Sheets

(56) References Cited

U.S. PATENT DOCUMENTS

| | | | | |
|---|---|---|---|---|
| 2,827,899 | A | 3/1958 | Altieri | |
| 2,847,003 | A | 8/1958 | Helmer et al. | |
| 2,933,811 | A | 4/1960 | Lifton | |
| 2,966,908 | A | 1/1961 | Cathcart et al. | |
| 3,016,052 | A | 1/1962 | Zubren | |
| 3,058,462 | A | 10/1962 | Greenblum | |
| 3,073,300 | A | 1/1963 | Berghash | |
| 3,082,765 | A | 3/1963 | Helmer | |
| 3,089,487 | A * | 5/1963 | Enicks et al. | 128/861 |
| 3,103,217 | A | 9/1963 | Butler et al. | |
| 3,107,667 | A | 10/1963 | Moore | |
| 3,124,129 | A | 3/1964 | Grossberg | |
| 3,126,002 | A | 3/1964 | Owens | |
| D198,359 | S | 6/1964 | McLeod | |
| 3,203,417 | A | 8/1965 | Helmer | |
| 3,207,153 | A | 9/1965 | Goldstein | |
| 3,223,085 | A | 12/1965 | Gores et al. | |
| 3,247,844 | A | 4/1966 | Berghash | |
| 3,312,218 | A | 4/1967 | Jacobs | |
| 3,319,626 | A | 5/1967 | Lindsay | |
| 3,333,582 | A | 8/1967 | Cathcart | |
| 3,407,809 | A | 10/1968 | Ross | |
| 3,411,501 | A | 11/1968 | Greenberg | |
| D212,848 | S | 12/1968 | Westlund et al. | |
| 3,416,527 | A | 12/1968 | Hoef | |
| 3,448,738 | A | 6/1969 | Berghash | |
| 3,457,916 | A | 7/1969 | Wolicki | |
| D215,685 | S | 10/1969 | Helmer | |
| 3,485,242 | A | 12/1969 | Greenberg | |
| 3,496,936 | A | 2/1970 | Gores | |
| 3,505,995 | A | 4/1970 | Greenberg | |
| 3,513,838 | A | 5/1970 | Foderick et al. | |
| 3,518,988 | A | 7/1970 | Gores | |
| 3,532,091 | A | 10/1970 | Lerman | |
| 3,682,164 | A | 8/1972 | Miller | |
| 3,692,025 | A | 9/1972 | Greenberg | |
| 3,768,465 | A | 10/1973 | Helmer | |
| 3,864,832 | A | 2/1975 | Carlson | |
| 3,916,527 | A | 11/1975 | Linkow | |
| RE28,667 | E | 12/1975 | Gores | |
| 3,924,638 | A | 12/1975 | Mann | |
| 3,943,924 | A | 3/1976 | Kallestad et al. | |
| D243,127 | S | 1/1977 | Farquharson | |
| 4,030,493 | A | 6/1977 | Walters et al. | |
| 4,044,762 | A | 8/1977 | Jacobs | |
| 4,063,552 | A | 12/1977 | Going et al. | |
| 4,114,614 | A | 9/1978 | Kesling | |
| 4,185,817 | A | 1/1980 | Peterson | |
| 4,211,008 | A | 7/1980 | Lerman | |
| 4,330,272 | A | 5/1982 | Bergersen | |
| 4,337,765 | A | 7/1982 | Zimmerman | |
| 4,346,205 | A | 8/1982 | Hiles | |
| 4,348,178 | A | 9/1982 | Kurz | |
| 4,376,628 | A | 3/1983 | Aardse | |
| 4,457,708 | A | 7/1984 | Dufour | |
| 4,519,386 | A | 5/1985 | Sullivan | |
| 4,568,280 | A | 2/1986 | Ahlin | |
| 4,591,341 | A | 5/1986 | Andrews | |
| 4,671,766 | A | 6/1987 | Norton | |
| 4,672,959 | A | 6/1987 | May et al. | |
| 4,673,791 | A | 6/1987 | Konno et al. | |
| 4,727,867 | A | 3/1988 | Knoderer | |
| 4,763,791 | A | 8/1988 | Halverson et al. | |
| 4,765,324 | A | 8/1988 | Lake, Jr. | |
| 4,791,941 | A | 12/1988 | Schaefer | |
| 4,793,803 | A | 12/1988 | Martz | |
| 4,799,500 | A | 1/1989 | Newbury | |
| 4,810,192 | A | 3/1989 | Williams | |
| 4,827,578 | A | 5/1989 | Heckerman | |
| 4,848,365 | A | 7/1989 | Guarlotti et al. | |
| 4,867,147 | A | 9/1989 | Davis | |
| 4,889,533 | A | 12/1989 | Beecher | |
| 4,924,557 | A | 5/1990 | Heckerman et al. | |
| 4,944,947 | A | 7/1990 | Newman | |
| 4,955,393 | A | 9/1990 | Adell | |
| 4,977,905 | A | 12/1990 | Kittelsen et al. | |
| 5,003,994 | A | 4/1991 | Cook | |
| 5,031,611 | A | 7/1991 | Moles | |
| 5,031,638 | A | 7/1991 | Castaldi | |
| 5,063,940 | A | 11/1991 | Adell et al. | |
| 5,076,785 | A | 12/1991 | Tsai | |
| 5,082,007 | A | 1/1992 | Adell | |
| 5,112,225 | A | 5/1992 | Diesso | |
| 5,117,816 | A | 6/1992 | Shapiro et al. | |
| D328,494 | S | 8/1992 | Schwendeman | |
| 5,152,301 | A | 10/1992 | Kittelsen et al. | |
| 5,154,609 | A | 10/1992 | George | |
| 5,165,424 | A | 11/1992 | Silverman | |
| 5,194,004 | A | 3/1993 | Bergersen | |
| 5,234,005 | A | 8/1993 | Kittelsen et al. | |
| 5,235,991 | A | 8/1993 | Minneman | |
| 5,259,762 | A | 11/1993 | Farrell | |
| 5,277,203 | A | 1/1994 | Hays | |
| D343,928 | S | 2/1994 | Kittelsen et al. | |
| 5,293,880 | A | 3/1994 | Levitt | |
| 5,299,936 | A | 4/1994 | Ueno | |
| 5,313,960 | A | 5/1994 | Tomasi | |
| 5,316,474 | A | 5/1994 | Robertson | |
| 5,320,114 | A | 6/1994 | Kittelsen et al. | |
| 5,323,787 | A | 6/1994 | Pratt | |
| 5,336,086 | A | 8/1994 | Simmen et al. | |
| 5,339,832 | A | 8/1994 | Kittelsen et al. | |
| 5,353,810 | A | 10/1994 | Kittelsen et al. | |
| 5,365,946 | A | 11/1994 | McMillan | |
| 5,385,155 | A | 1/1995 | Kittelsen et al. | |
| D356,188 | S | 3/1995 | Kittelsen | |
| 5,406,963 | A * | 4/1995 | Adell | 128/861 |
| 5,415,544 | A | 5/1995 | Oxman et al. | |
| 5,447,168 | A | 9/1995 | Bancroft | |
| 5,460,527 | A | 10/1995 | Kittelsen | |
| 5,566,683 | A | 10/1996 | Thornton | |
| 5,566,684 | A | 10/1996 | Wagner | |
| 5,584,687 | A | 12/1996 | Sullivan et al. | |
| 5,624,257 | A | 4/1997 | Farrell | |
| 5,636,379 | A | 6/1997 | Williams | |
| 5,642,737 | A | 7/1997 | Parks | |
| D382,965 | S | 8/1997 | Wagner | |
| 5,692,523 | A * | 12/1997 | Croll et al. | 128/859 |
| 5,718,575 | A | 2/1998 | Cross, III | |
| 5,746,221 | A | 5/1998 | Jones et al. | |
| D397,442 | S | 8/1998 | Kittelsen | |
| 5,826,581 | A | 10/1998 | Yoshida | |
| 5,836,761 | A | 11/1998 | Belvedere et al. | |
| 5,865,619 | A | 2/1999 | Cross, III et al. | |
| 5,879,155 | A | 3/1999 | Kittelsen | |
| 5,970,981 | A | 10/1999 | Ochel | |
| 6,012,919 | A | 1/2000 | Cross, III et al. | |
| 6,082,363 | A | 7/2000 | Washburn | |
| 6,142,780 | A | 11/2000 | Burgio | |
| 6,200,133 | B1 | 3/2001 | Kittelsen et al. | |
| 6,237,601 | B1 | 5/2001 | Kittelsen et al. | |
| D452,011 | S | 12/2001 | Redhage | |
| 6,371,758 | B1 | 4/2002 | Kittelsen et al. | |
| 6,405,729 | B1 | 6/2002 | Thornton | |
| 6,415,794 | B1 | 7/2002 | Kittelsen et al. | |
| 6,505,626 | B2 | 1/2003 | Kittelsen et al. | |
| 6,505,627 | B2 | 1/2003 | Kittelsen et al. | |
| 6,505,628 | B2 | 1/2003 | Kittelsen et al. | |
| 6,508,251 | B2 | 1/2003 | Kittelsen et al. | |
| 6,510,853 | B1 | 1/2003 | Kittelsen et al. | |
| 6,539,943 | B1 | 4/2003 | Kittelsen et al. | |
| 6,553,996 | B2 | 4/2003 | Kittelsen et al. | |
| 6,584,978 | B1 * | 7/2003 | Brett et al. | 128/859 |
| 6,598,605 | B1 | 7/2003 | Kittelsen et al. | |
| 6,638,496 | B2 | 10/2003 | McLaughlin | |
| 6,675,806 | B2 | 1/2004 | Kittelsen et al. | |
| D492,785 | S | 7/2004 | Garabito | |
| D504,744 | S | 5/2005 | Hidalgo et al. | |
| 6,978,786 | B2 | 12/2005 | Sabbagh | |
| D527,848 | S | 9/2006 | Manzo et al. | |
| D530,425 | S | 10/2006 | Carlson | |
| D530,863 | S | 10/2006 | Manzo et al. | |
| D532,559 | S | 11/2006 | Manzo et al. | |
| D541,481 | S | 4/2007 | Farrell | |

(56) References Cited

U.S. PATENT DOCUMENTS

| | | | |
|---|---|---|---|
| D548,402 | S | 8/2007 | Trodick |
| 7,299,804 | B2 | 11/2007 | Kittelsen et al. |
| D570,724 | S | 6/2008 | Kittelsen |
| D586,252 | S | 2/2009 | Kittelsen |
| D593,714 | S | 6/2009 | Hirshberg |
| D594,125 | S | 6/2009 | Lesniak |
| D597,675 | S | 8/2009 | Eli |
| 7,658,193 | B2 | 2/2010 | Lesniak |
| D614,304 | S | 4/2010 | Jansheski |
| D641,478 | S | 7/2011 | Belvedere et al. |
| 8,033,392 | B1 | 10/2011 | Gehner et al. |
| 8,116,854 | B2 | 2/2012 | Hart et al. |
| D663,485 | S | 7/2012 | Turkbas et al. |
| D663,486 | S | 7/2012 | Turkbas et al. |
| 2003/0019497 | A1 | 1/2003 | Farrell |
| 2004/0110111 | A1 | 6/2004 | Wasylucha |
| 2004/0154626 | A1 | 8/2004 | Washburn et al. |
| 2004/0250817 | A1 | 12/2004 | Kittelsen et al. |
| 2011/0114100 | A1 | 5/2011 | Alvarez et al. |
| 2011/0186055 | A1 | 8/2011 | Makkar et al. |
| 2012/0085354 | A1 | 4/2012 | Polk, III |

FOREIGN PATENT DOCUMENTS

| | | |
|---|---|---|
| CA | 886254 | 11/1971 |
| CA | 1147583 | 6/1983 |
| DE | 0480423 | 8/1929 |
| EP | 0426172 | 7/1994 |
| EP | 0651670 | 5/1995 |
| WO | WO 91/03215 | 3/1991 |
| WO | WO 93/08761 | 5/1993 |
| WO | WO 00/35369 | 6/2000 |
| WO | WO 2009/026538 | 2/2009 |

OTHER PUBLICATIONS

International Search Report issued in PCT/US94/05306, mailed Oct. 4, 1994, 3 pages.

* cited by examiner

CUSTOM MOUTHGUARD

CROSS-REFERENCE TO RELATED APPLICATIONS

This application claims the benefit under 35 U.S.C. §119 (e) of U.S. provisional application 61/350,555 filed Jun. 2, 2010 and entitled "Custom Mouthguard," which is hereby incorporated by reference in its entirety.

TECHNICAL FIELD

The invention relates generally to custom mouthguards and methods of manufacturing custom mouthguards.

BACKGROUND

Conventional custom mouthguards are manufactured using a dental impression or replica of an individual's teeth, in particular the individual's upper teeth. The individual is provided with a tray filled with a modeling compound, which forms a negative impression when bitten. The negative impression may then be used to form a positive mold of the individual's teeth. Custom mouthguards have been created from the negative impression by vacuum forming or heat laminating generally thin polymer layers around the positive mold,

SUMMARY

A custom mouthguard may include a multiple layer assembly including a first thermoplastic layer, a second thermoplastic layer and an intervening and/or embedded impact shield and/or elastomeric framework. The elastomeric framework may include one or more posterior occlusal pads partially or completely embedded in or disposed between the thermoplastic layers, The custom mouthguard may be molded to a positive mold of an individual's upper teeth and gums.

A method of forming a custom mouthguard may include vacuum forming a first polymer layer onto a positive mold of a dental impression, positioning a molded impact shield adjacent the first layer, and vacuum forming a second layer onto the positive mold, thereby encapsulating at least a portion of the impact shield between the first and second layers. The impact shield may include an anterior portion having an opening. After forming the customer mouthguard, the first and/or second layers may be pierced to form a throughole for attaching a strap.

An illustrative example may be found in a method of manufacturing a custom mouthguard for an individual. A positive mold of the individual's upper teeth and gums may be obtained. A first layer that includes an ethylene vinyl acetate/thermoplastic polyurethane copolymer may be molded onto the positive mold. An impact shield and framework may be disposed on the first layer and a second layer including ethylene vinyl acetate may be molded onto the positive mold, thereby encapsulating a portion of the impact shield and framework.

Another illustrative example may be found in a custom mouthguard having a tray floor, an outer labial wall and an inner lingual wall. The custom mouthguard may include a first layer having an ethylene vinyl acetate/thermoplastic copolymer, a second layer including an ethylene vinyl acetate polymer, and a rubber impact shield disposed between the first layer and the second layer. The first layer may form a substantial portion of the tray floor and the outer labial wall while the second layer may form a substantial portion of the inner lingual wall.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
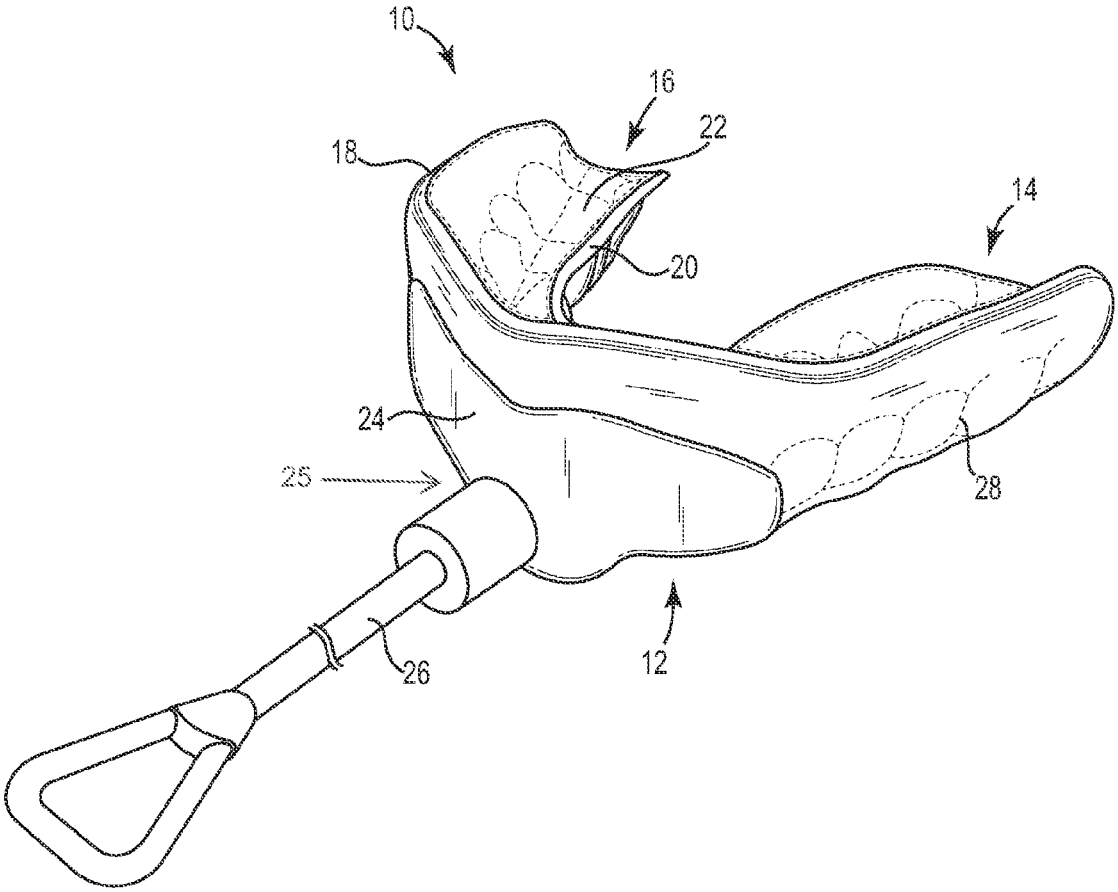
FIG. 1 is a perspective view of a custom mouthguard.

FIG. 1 is a perspective view of a custom mouthguard 10 having an anterior side 12 and a posterior side 14. The mouthguard 10 includes a U-shaped tray 16 having an outer labial wall 18, an inner lingual wall 20 and an intervening tray floor 22. An impact shield 24 is at least partially embedded in the outer labial wall 18 at or near the anterior side 12 of the mouthguard 10. In some embodiments, a retention strap 26 may be secured to the impact shield 24 via a through-hole 25 that is sized to accommodate the retention strap 26 in a releasable manner.

Figure 2:
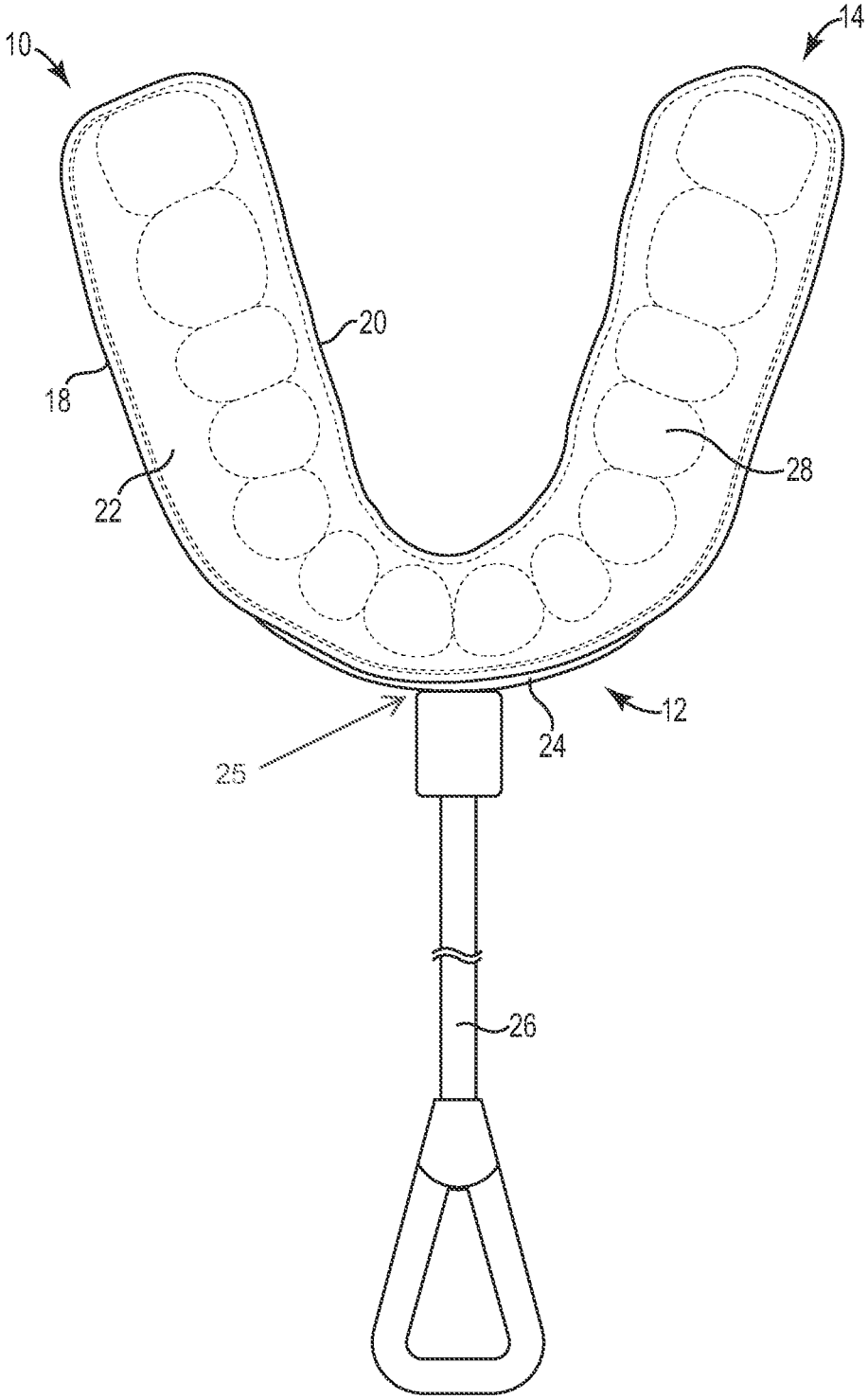
FIG. 2 is a top view of the custom mouthguard of FIG. 1.

Teeth marks 28 extend into the outer labial wall 18, the inner lingual wall 20 and the tray floor 22. FIG. 2 is a top view of the mouthguard 10 and shows how the teeth marks 28 are disposed along the tray floor 22. It will be appreciated that the teeth marks 28 illustrated herein are stylized and are intended to generically represent the imprints made to fit an individual's teeth.

Figure 3:
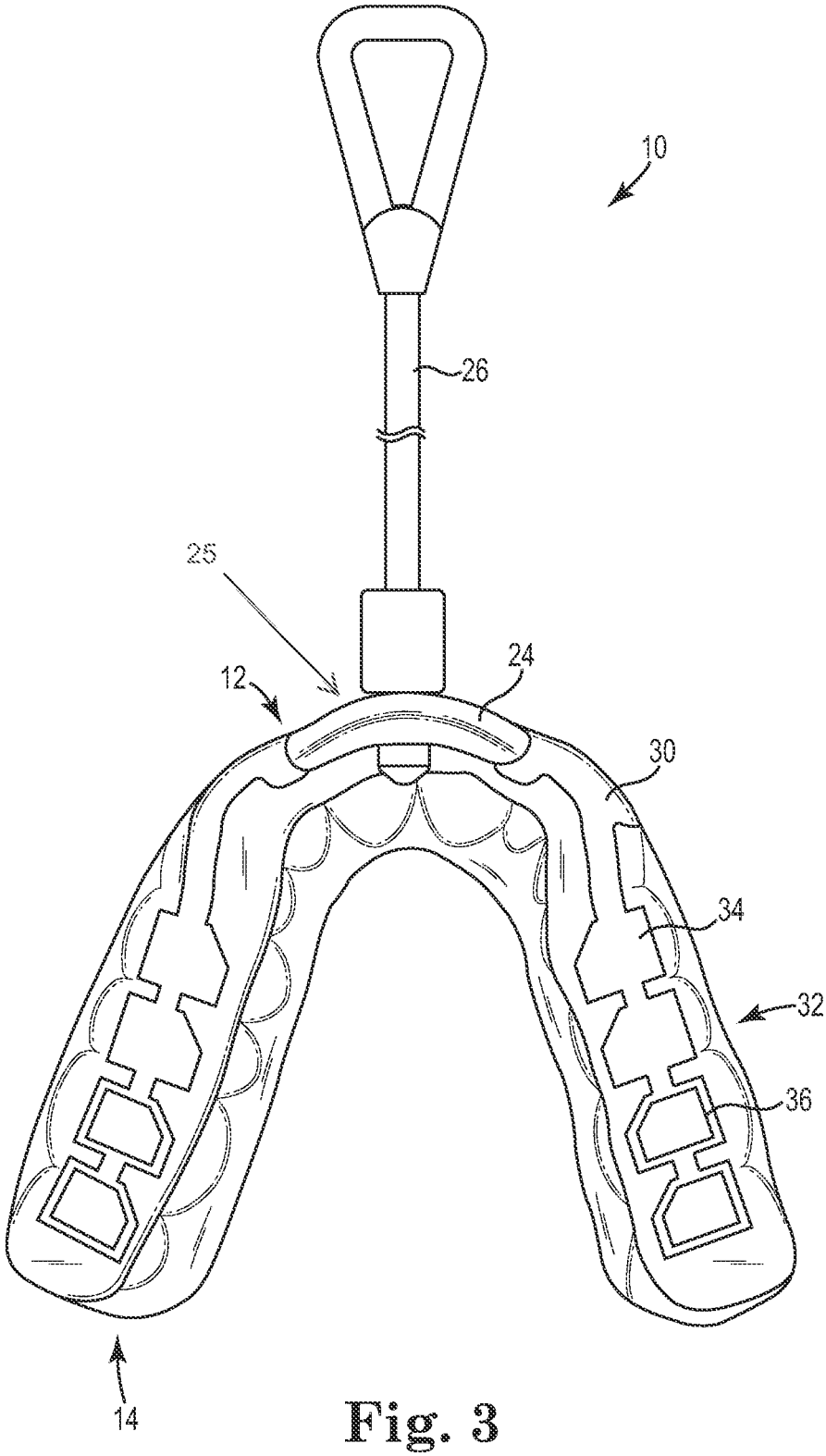
FIG. 3 is a bottom view of the custom mouthguard of FIG. 1.

In some embodiments, the impact shield 24 includes structure that extends from the impact shield 24 towards the posterior side 14 of the mouthguard 10, FIG. 3 is a bottom view of the mouthguard 10, showing how the impact shield 24 includes a framework 30 that includes one or more posterior occlusal pads 32. Like the anterior portion of the impact shield 24, the framework is at least partially embedded in the U-shaped tray 16. In some embodiments, the posterior occlusal pads 32 include one or more solid pads 34 and one or more open pads 36, as illustrated. It will be appreciated that the configuration of the framework 30 and the posterior occlusal pads 32 may be altered to provide desired jaw protection and alignment.

Figure 4:
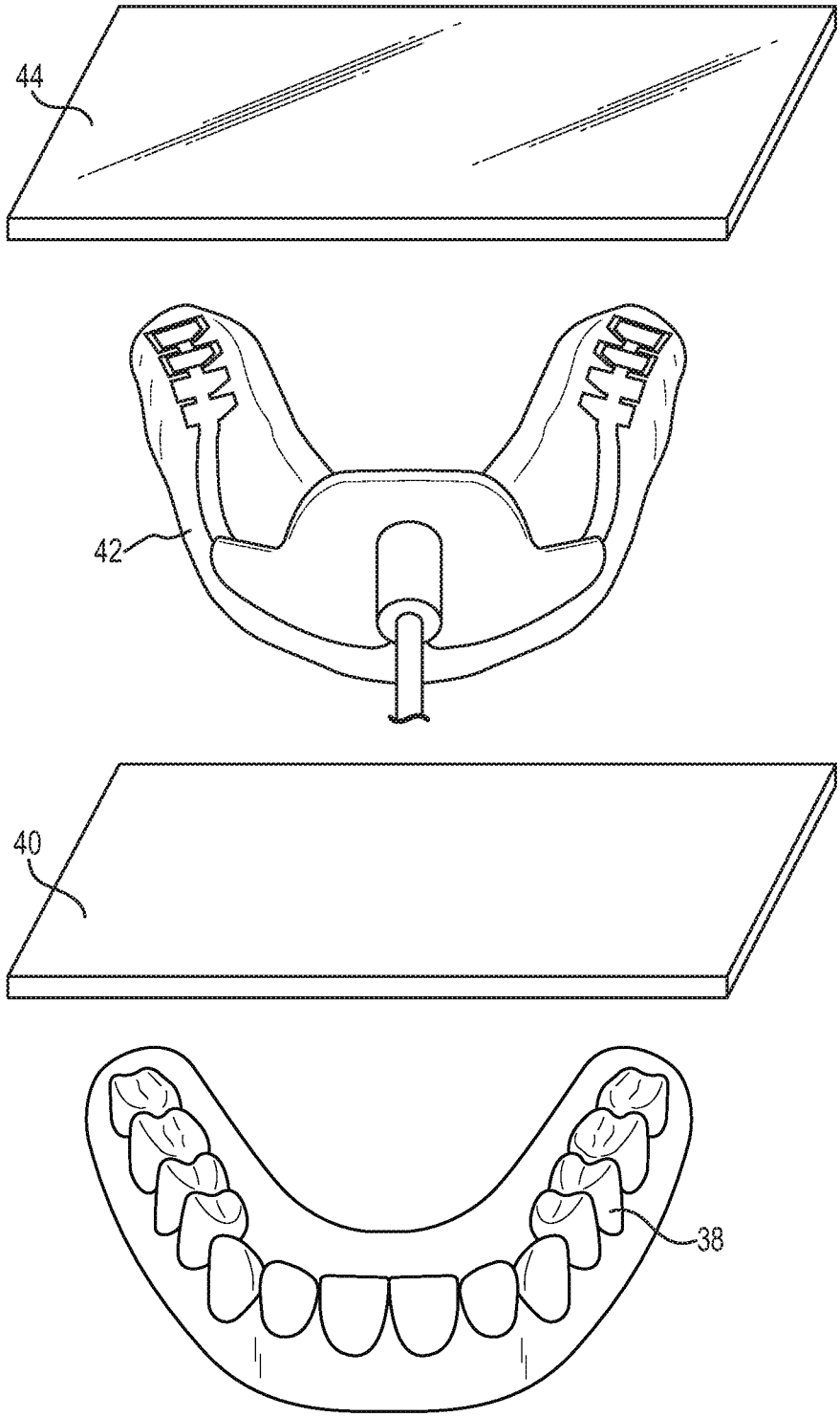
FIG. 4 is a schematic illustration of the layers used to form the custom mouthguard of FIG. 1.

FIG. 4 is a schematic illustration of how the mouthguard 10 may be manufactured by vacuum forming or heat lamination methods. A positive mold 38 is positioned on a work surface of a vacuum forming apparatus (not shown). A first layer 40 is then evenly heated and vacuum formed or heat laminated around the positive mold. The first layer is then optionally trimmed before or after applying an optional layer of adhesive. The pre-formed molded impact brace 42 is then positioned adjacent to the first layer 40 on the optional adhesive, and a second layer 44 is then evenly heated and placed over the first layer 40 and impact shield 42 such that the application of a vacuum or heat lamination causes at least portions of the impact shield 42 to be encapsulated within the first and second layers. Any excess layer material from the second layer 44 is then optionally trimmed from the mouthguard, and a hole may be formed in the second layer 44 at the point where the retention strap is optionally attached. Although this process is described sequentially, in one embodiment the first layer 40, impact shield 42 and second layer 44 are vacuum formed substantially simultaneously.

Each of the layers may be formed of distinct materials that provide the resulting mouthguard 10 with desired properties and performance. In some embodiments, the first layer 40 may form a substantial portion of the tray floor 22 as well as an inner surface of the outer labial wall 18. As such, the first layer 40 may provide a substantial amount of impact protection to the wearer's teeth. The first layer 40 may be formed of any suitable material that provides a desired level of impact resistance, Illustrative but non-limiting examples of suitable materials include blends of EVA (ethylene vinyl acetate) and TPU (thermoplastic polyurethane), In some embodiments, the first layer 40 is formed from an EVA/TPU available commercially under the CORESHOCK® tradename.

In one embodiment, the impact shield 42 is a molded part formed from a polymer that provides a desired blend of strength and impact energy dissipation. In some embodiments, the shield 42 is formed of a composite of a copolymer of ethylene and vinyl acetate and an elastomeric material such as thermoplastic rubber or vulcanized rubber. An example of a suitable copolymer of ethylene and vinyl acetate is ELVAX® resin marketed by the OP Division of Ashland Chemical Co, such as ELVAX® 350 through ELVAX® 450. In one embodiment, ELVAX® 450 is used, which has 18% by weight vinyl acetate. In some embodiments, the impact shield 42 includes 50% to 80% by weight of the elastomeric material and 20% to 50% by weight of the copolymer of ethylene and vinyl acetate.

In some embodiments, the elastomeric material is a thermoplastic rubber available commercially under the KRATON® tradename, from GLS Plastics of 740B Industrial Drive, Cary, Ill. 60013. This thermoplastic rubber is unique in that it is injection moldable, FDA approved and readily adheres with copolymers of ethylene and vinyl acetate, In some embodiments, the second layer 44 may form a substantial portion of the inner lingual wall 20. The second layer 44 may be formed of any suitable material. In some cases, the second 44 may be formed of a clear material. In some embodiments, the second layer 44 may be formed of a copolymer of ethylene and vinyl acetate, such as EVA. In one embodiment, the second layer 44 may be formed from a material that softens when contacted with boiling water such that a user can further augment the dental impression formed in the mouthguard tray.

Figure 5:
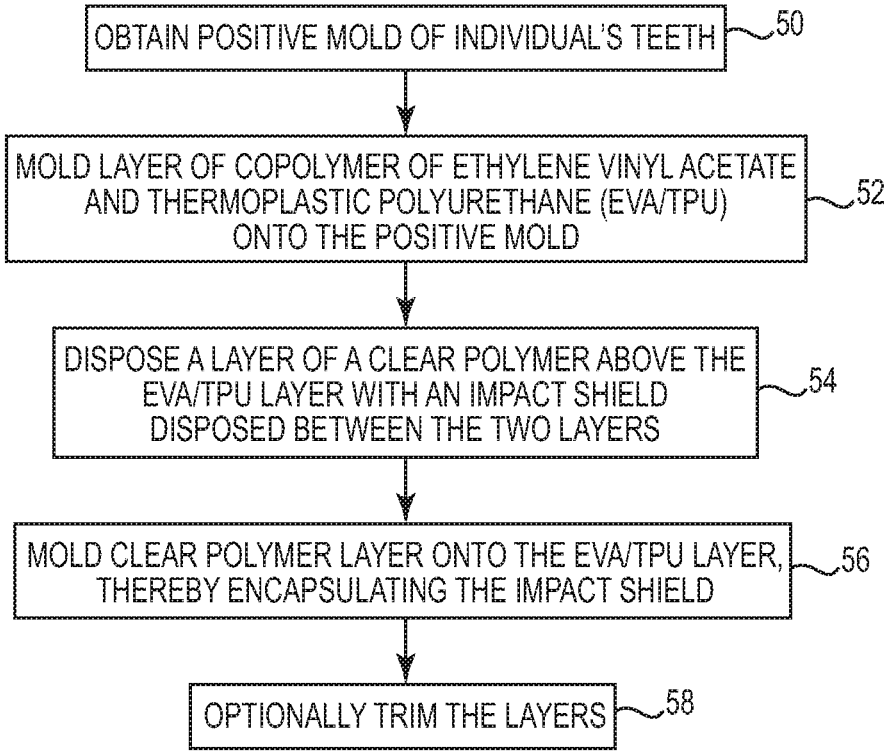
FIG. 5 is a flow diagram illustrating a method of forming the custom mouthguard of FIG. 1.

FIG. 5 is a flow diagram showing an illustrative method for forming the custom mouthguard 10. A positive mold of an individual's teeth, or at least their upper teeth, is obtained as generally shown at block 50. At block 52, a layer including a copolymer of ethylene vinyl acetate and thermoplastic polyurethane is molded onto the positive mold. A layer including a clear polymer such as EVA is disposed above the EVA/TPU layer with an impact shield disposed between the two layers, as generally shown at block 54. At block 56, the layer of EVA is molded onto the EVA/TPU layer, thereby encapsulating the impact shield. Optionally, as shown in block 58, the layers may be trimmed and/or a hole may be formed in the EVA layer to connect the retention strap 26.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A method of manufacturing a multi-layer custom mouthguard for a user, comprising the steps of:

forming a first layer over a positive mold of the user's teeth, the first layer including a thermoplastic polymer;

positioning a molded impact shield adjacent the first layer;

vacuum forming a second layer over the positive mold, thereby encapsulating at least a portion of the impact shield between the first and second layers, the second layer including a thermoplastic copolymer.

2. The method of claim 1, further comprising trimming the first layer and the second layer.

3. The method of claim 1, wherein molding the second layer onto the positive mold occurs at the same time as molding the first layer onto the positive mold.

4. The method of claim 1, wherein molding the second layer onto the positive mold occurs after molding the first layer onto the positive mold.

5. The method of claim 1 further comprising the step of applying a layer of adhesive on the first layer prior to positioning the molded impact shield.

6. The method of claim 1 wherein the impact shield includes a hole in an anterior portion and wherein the method further comprises the step of forming a hole in the second layer that is aligned with the hole in the impact shield.

7. The method of claim 1 wherein the first layer comprises a copolymer of ethylene vinyl acetate and thermoplastic polyurethane.

8. The method of claim 7 wherein the first layer forms a substantial portion of a tray floor and an inner surface of an outer labial wall of the custom mouthguard.

9. The method of claim 1 wherein the second layer comprises ethylene vinyl acetate.

10. The method of claim 9 wherein the second layer forms a substantial portion of an inner lingual wall of the custom mouthguard.

11. A multi-layer custom mouthguard customized for a user, the mouthguard comprising:

a U-shaped base having an outer labial wall, an inner lingual wall and an intervening tray floor, the U-shaped base comprising a first layer of a copolymer of ethylene vinyl acetate and thermoplastic polyurethane and a second layer of ethylene vinyl acetate formed over a positive mold of the user's teeth;

an impact shield at least partially embedded between the at least two layers in the outer labial wall at an anterior end of the U-shaped tray; and first and second shock absorbers at least partially embedded between the at least two layers in the tray floor at posterior ends of the U-shape tray, the first and second shock absorbers each including at least one embedded pad having an opening disposed therethrough.

12. The custom mouthguard of claim 11 wherein the first layer forms a substantial portion of the tray floor and an inner surface of the outer labial wall.

13. The custom mouthguard of claim 12 wherein the second layer forms a substantial portion of the inner lingual wall.

14. The custom mouthguard of claim 11 comprising a through-hole formed through the second layer and the impact shield.

15. The custom mouthguard of claim 14 further comprising a releasable tether positioned in the through-hole.

16. The custom mouthguard of claim 11 wherein the second layer of ethylene vinyl acetate is a clear layer.

17. A multi-layer custom mouthguard customized for a user, the mouthguard comprising:

a U-shaped base having an outer labial wall, an inner lingual wall and an intervening tray floor, the U-shaped base comprising first and second polymeric layers formed over a positive mold of the user's teeth, the first polymeric layer forming a substantial portion of the tray floor and the outer labial wall, the second polymeric layer forming a substantial portion of the inner lingual wall, the first polymeric layer and the second polymeric layer formed of different polymers;

an impact shield at least partially embedded between the first and second polymeric layers in the outer labial wall at an anterior end of the U-shaped tray; and first and second shock absorbers at least partially embedded between the first and second polymeric layers in the tray floor at posterior ends of the U-shape tray, the first and second shock absorbers each including at least one embedded pad having an opening disposed therethrough.

18. The custom mouthguard of claim 17 wherein the second polymeric layer comprises ethylene vinyl acetate.

19. The custom mouthguard of claim 17 wherein the first polymeric layer comprises a copolymer of ethylene vinyl acetate and thermoplastic polyurethane and a second layer of ethylene vinyl acetate.

* * * * *